US005859635A

United States Patent [19]

Hang et al.

[11] Patent Number: 5,859,635

[45] Date of Patent: Jan. 12, 1999

[54] POLARITY SYNCHRONIZATION METHOD AND APPARATUS FOR VIDEO SIGNALS IN A COMPUTER SYSTEM

[75] Inventors: Chia-Lun Hang, San Jose; Jih-Hsien Soong, Cupertino, both of Calif.

[73] Assignee: Cirrus Logic, Inc., Fremont, Calif.

[21] Appl. No.: 922,524

[22] Filed: Sep. 3, 1997

Related U.S. Application Data

[63] Continuation of Ser. No. 471,129, Jun. 6, 1995, abandoned.

[51] Int. Cl.[6] ..... G09G 5/00

[52] U.S. Cl. ..... 345/213

[58] Field of Search ..... 348/500, 521, 348/558; 345/213, 132, 501, 502, 503, 504, 505, 506

[56] References Cited

U.S. PATENT DOCUMENTS

| | | | |
|---|---|---|---|
| Re. 33,916 | 5/1992 | Saenz et al. | 345/22 |
| 4,727,362 | 2/1988 | Rackley et al. | 345/22 |
| 4,779,132 | 10/1988 | McBeath et al. | 348/547 |
| 4,800,429 | 1/1989 | Perkins | 348/500 |
| 4,991,023 | 2/1991 | Nicols | 348/554 |
| 5,021,719 | 6/1991 | Arai et al. | 315/364 |
| 5,027,212 | 6/1991 | Marlton et al. | 348/512 |
| 5,111,190 | 5/1992 | Zenda | 345/3 |
| 5,159,327 | 10/1992 | Yi | 345/213 |
| 5,285,197 | 2/1994 | Schmidt et al. | 345/213 |
| 5,394,171 | 2/1995 | Rabii | 345/213 |
| 5,404,153 | 4/1995 | Kim | 345/213 |

*Primary Examiner*—Tod R. Swann
*Assistant Examiner*—Conley B. King, Jr.
*Attorney, Agent, or Firm*—Robert P. Bell; Steven A. Shaw

[57] ABSTRACT

A method and apparatus for automatically synchronizing the polarity of video signals generated by a graphics controller card to a display monitor is described. The present invention includes hardware circuitry comprising a storage unit, a detection unit, a selection unit that store, detect, and select input video signals, particularly a vertical and a horizontal synchronization signals, with the same or different polarity that are received from the graphics controller to a display monitor. The present invention synchronizes the polarity of input vertical and horizontal synchronization signals from the graphics controller prior to transmitting the sync signals to the display monitor. The detect and selection circuits of the present invention enable polarity of input sync signals to be synchronized without the use of software as practiced in the prior art.

12 Claims, 5 Drawing Sheets

POLARITY SYNCHRONIZATION METHOD AND APPARATUS FOR VIDEO SIGNALS IN A COMPUTER SYSTEM

This application is a continuation of application Ser. No. 08/471,129 filed Jun. 6, 1995, now abandoned.

BACKGROUND OF THE INVENTION

1. Field of the Invention

The present invention relates to the field of multi-media computer systems. More specifically, the present invention relates to a method and circuitry for processing sync pulses in a multi-media PC wherein the circuitry automatically synchronizes the polarity of the horizontal and vertical sync pulses respectively.

2. Description of Related Art

Personal computer (PCs) systems have evolved into multi-media systems adapted to run multi-media software including video information displayed on PC monitors and other video display monitors. The introduction of multi-media computers also means that computer users may now purchase off the shelf add-on peripherals such as graphics and video cards to give their PCs multi-media capabilities.

As the use of multi-media systems has increased in popularity, so has the need to process multi-media information. To adequately handle the increased popularity of multi-media information processing, system designers must consider new techniques of controlling the simultaneous processing and displaying of video and graphics data in a multi-media system without losing display clarity, picture distinction, or over-task system resources. The need to design new video processing and display techniques may also be complicated by the need to simplify the use of such technology for less sophisticated users.

FIG. 1 is a simplified block diagram of a multi-media computer system 100. System 100 includes a central processing unit (CPU) 110 for processing information, main memory 120 coupled to CPU 110 for storing data and instructions needed by CPU 110, system bus 105 coupled to CPU 110 for communicating information between CPU 110 and other peripheral devices in system 100. System 100 also includes video graphics adapter (VGA) controller 130 which couples to system bus 105 for processing video and graphics data in system 100, display monitor 140 including a display screen to display video and graphics data in system 100. System 100 further includes video card 150 for generating video data in system 100.

In the system shown in FIG. 1, when graphics and video data are displayed on display monitor 140, VGA controller 130 includes internal registers which store video and graphics data which may be used for display hardware control (i.e., display monitor 140). VGA controller 130 controls graphics information displayed in display monitor 140. The information controlled by VGA controller 130 may include horizontal and vertical synchronization pulses (VSYNC±304 and HSYNC) and other video signals.

Horizontal and vertical sync signals dictate the scan rate of display in display monitor 140. The horizontal sync signal occurs once every horizontal line on the screen in display monitor 140; thereby synchronizing display monitor 140 to video card 150. Video card 150 sends data to display monitor 140 via a serial video bus. The serial video data stream feeding display monitor 140 from video card 150 begins at the left hand side of the screen of display monitor 140 and scans across to the right hand side of the screen. At the end of a line, a horizontal sync signal is asserted by the VGA controller 130 to indicate the end of a scan line.

After receiving the horizontal pulse, display monitor 140 sends an electronic beam back to the left border of the screen and begins scanning to the right. In order to synchronize display data, the display monitor 140 and VGA controller 130 have to be compatible. Compatibility is required because if VGA controller 130 is sending data too slowly, the screen scanning mechanism in display monitor 140 will reach the right hand side of the screen and then wait for the next horizontal sync pulse. Waiting for the next HSYNC pulse may result in the left portion of the video or graphics data being displayed without the right portion of the display. Furthermore, if the sync pulses are sent out too quickly, the screen scanning mechanism will never refresh the right portion of the screen resulting in display distortions in display monitor 140.

To prevent display distortions in display monitor 140, VGA controller 130 includes internal registers which store data which may be used to program the HSYNC and VSYNC signal as well as a field storing data indicative of the polarity of the pulses. The polarity data controls the pulse shape of the horizontal and vertical sync pulses which in turn control the vertical and horizontal sizes of the screen. The polarity of the sync pulses also alerts the screen as to how many vertical and horizontal lines should be displayed. HSYNC and VSYNC signals must possess a correct polarity corresponding to the display monitor 140. Otherwise, a reverse or negative image may be produced on the screen on display monitor 140.

Many prior art graphics and video cards are auto-synchronizing which means that the display screens in display monitor 140 must be capable of achieving vertical and horizontal synchronization. To achieve such synchronization, the display monitor 140 must also be capable of detecting the polarity of the horizontal and vertical sync pulses. After detecting the polarity of the sync pulses, display monitor 140 must be able to synchronize the polarity of the sync pulses in order to increase the number of vertical and horizontal lines that can be displayed.

To synchronize the polarity of the sync pulses, many prior art systems use computer program software stored in registers in the video card and VGA controller 130 to program the polarity of the sync signals. VGA controller 130 and video card 150 are therefore charged with synchronizing the polarity of the sync pulses by communicating with their respective registers over the system bus 105 when a program detects that display mode in display monitor 140 has changed or is about to change.

Using software to control polarity synchronization thus requires the VGA controller 130 to contend with other peripheral devices in system 100 to communicate with CPU 110. Such bus contention can be expensive and time consuming since VGA controller 130 may not always have priority over other system devices. The VGA controller 130 may then have to wait to gain control of the system bus 105 if it loses priority to other system devices. Such wait periods may result in display distortions, delay in displaying graphics and video data, etc.

Another problem with using software to perform polarity synchronization of sync pulses is the cost associated with upgradability. Anytime CPU 110 or VGA controller 130 is upgraded, the polarity synchronization software must also be upgraded to insure compatibility. Such software upgrades can be expensive and may lag behind hardware upgrades which may often result in the ability to switch the video card 150 and VGA controller 130 among different computer systems.

Yet another problem with the prior art system may be that the user of a software programmable graphics controller and video card, will have to know anytime the display mode changes, for example from 1024×768 pixels to 1280×1024 pixels, in the computer system in order to reprogram the graphics controller and the video card. This can often be a difficult task, especially if the user is not sophisticated enough or does not know how to program the different cards.

To solve the problem associated with using software to synchronize the polarity of sync pulses take to synchronize display signals, an improved and less expensive way of achieving sync signals polarity synchronization in a graphics controller and video card is desired.

SUMMARY OF THE INVENTION

The present invention provides a method and apparatus for automatically synchronizing the polarity of horizontal and vertical sync pulses in a multi-media computer system. The synchronization circuit of the present invention includes a storage unit for receiving a plurality of signals including a horizontal and a vertical sync signal, a detection unit for determining the polarity of the input horizontal and vertical signals which are stored in the storage unit, a selection unit for decoding and selecting portions of the sync signals to be displayed on a display monitor attached to a host computer system.

The storage unit is operable to simultaneously receive and store a plurality of signals including horizontal, vertical sync signals, and a blankn signal which controls the display of images in a display unit. The HSYNC and VSYNC signals received by the storage unit have different polarities. The storage further unit includes an amplification mechanism to amplify the plurality of signals stored in the storage unit.

The detection unit is operable to receive stored signals from the storage unit. The detection unit includes a plurality of inverting circuits to invert the polarity of the received HSYNC and VSYNC signals based on the predefined output of the preferred embodiment while utilizing the blankn signal in determining the polarity of the received HSYNC and VSYNC signals.

The selection unit of the preferred embodiment includes a decoding means to decode the inverted HSYNC and VSYNC signals and to generate a synchronized polarity signal in response to the HSYNC and VSYNC signals. The selection unit further includes predefined data which may be used to synchronize the polarity of the HSYNC and VSYNC signals respectively.

DETAILED DESCRIPTION OF THE PREFERRED EMBODIMENT

FIGS. 2 through 5 of the drawings disclose various embodiments of the present invention for purposes of illustration only. One skilled in the art will readily recognize from the following discussion that alternative embodiments of the structures and methods illustrated herein may be employed without departing from the principles of the invention.

Figure 1:
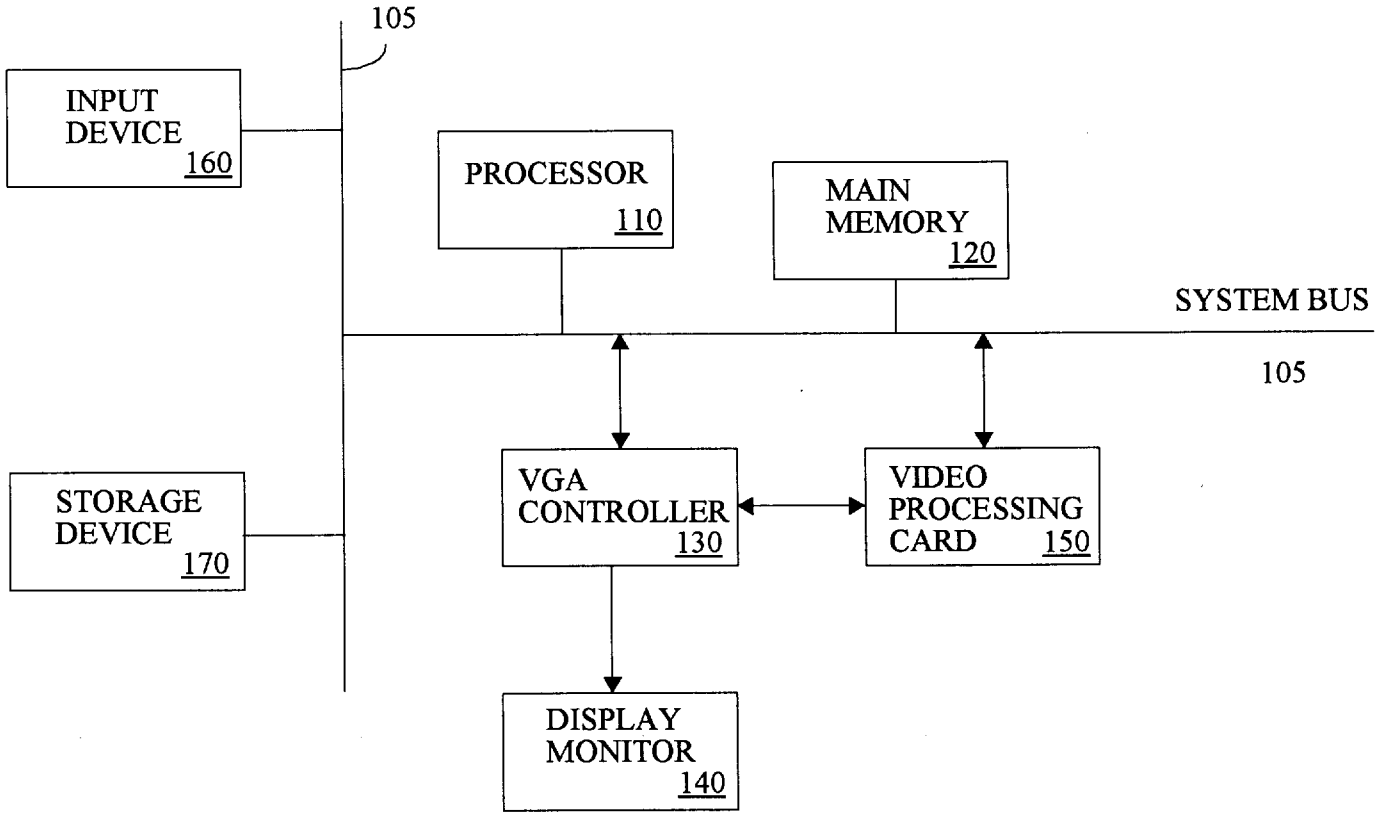
Fig. 1 (Prior Art)
FIG. 1 is a block diagram of a typical architecture of a computer system of the prior art.
Figure 2:
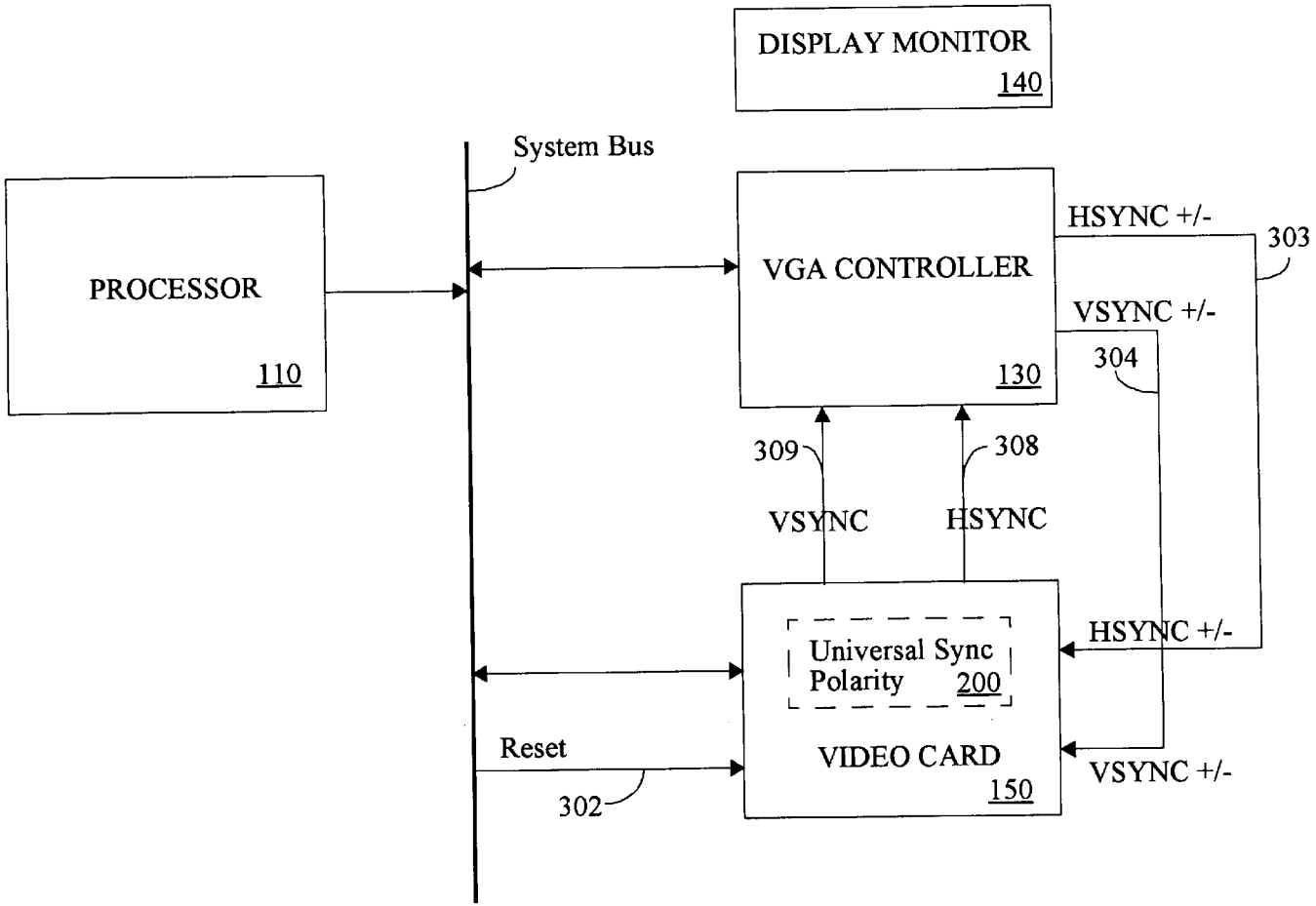
FIG. 2 is a block diagram of a computer system of the present invention.

Reference is first made to FIG. 2 which is a high level block diagram showing one embodiment of a graphics controller, a video card, and a display monitor of the present invention.

As shown in FIG. 2, graphics controller (VGA) 130 is coupled to display monitor 140 and video card 150 via system bus 105 and sync pulse signals (VSYNC±304 and HSYNC±304) to control video and graphics displays to display monitor 140. VGA 130 includes a number of functional units (not shown) for interfacing with display monitor 140. Among these functional blocks is a CRT controller which generates horizontal synchronization (HSYNC±303 ) and vertical synchronization (VSYNC±304 signals to the display monitor 140.

Video card 150 is coupled to VGA 130 via system bus 105 to store and generate video data to VGA 130. Video card 150 includes a universal polarity synchronization (UPSC) circuit 200 which may synchronize polarity of the horizontal and vertical signals generated by VGA 130 to video card 150 and the display monitor 140. Display monitor 140 is coupled to VGA 130 to receive and display graphics and video data via sync and other video signals.

During a normal operation of the computer system shown in FIG. 2, UPSC 200 receives and automatically synchronizes polarity of HSYNC±303 and VSYNC±304 signals generated by VGA 130 to video card 150 to process video data stored in video card 150 depending on resolution of display monitor 140. For example, if display resolution of display monitor 140 changes and VGA 130 sends negative HSYNC±303 and a positive VSYNC±304 signals to video card 150 to accommodate a change in display resolution, polarity of HSYNC±308 and VSYNC 309 signals may have to be synchronized to the same polarity (i.e., either positive or negative) in order to be able to display video data in a new display resolution.

Upon receiving sync signals from VGA 130, video card 150 ascertains the polarity of such sync signals and automatically synchronizes polarity if UPSC 200 detects a difference in polarity of the signals. If display resolution changes in display monitor 140, requiring polarity generated by video card 150 to change as a result, UPSC 200 automatically adjusts sync signals by synchronizing the signals in order to be able to display video data generated by video card 150 properly on display monitor 140.

By automatically detecting and ascertaining differences in polarity of sync signals, UPSC 200 is able to convert and synchronize sync signals "on-the-fly" depending on what display resolution is in the display monitor 140, without any user interruption.

Figure 3:
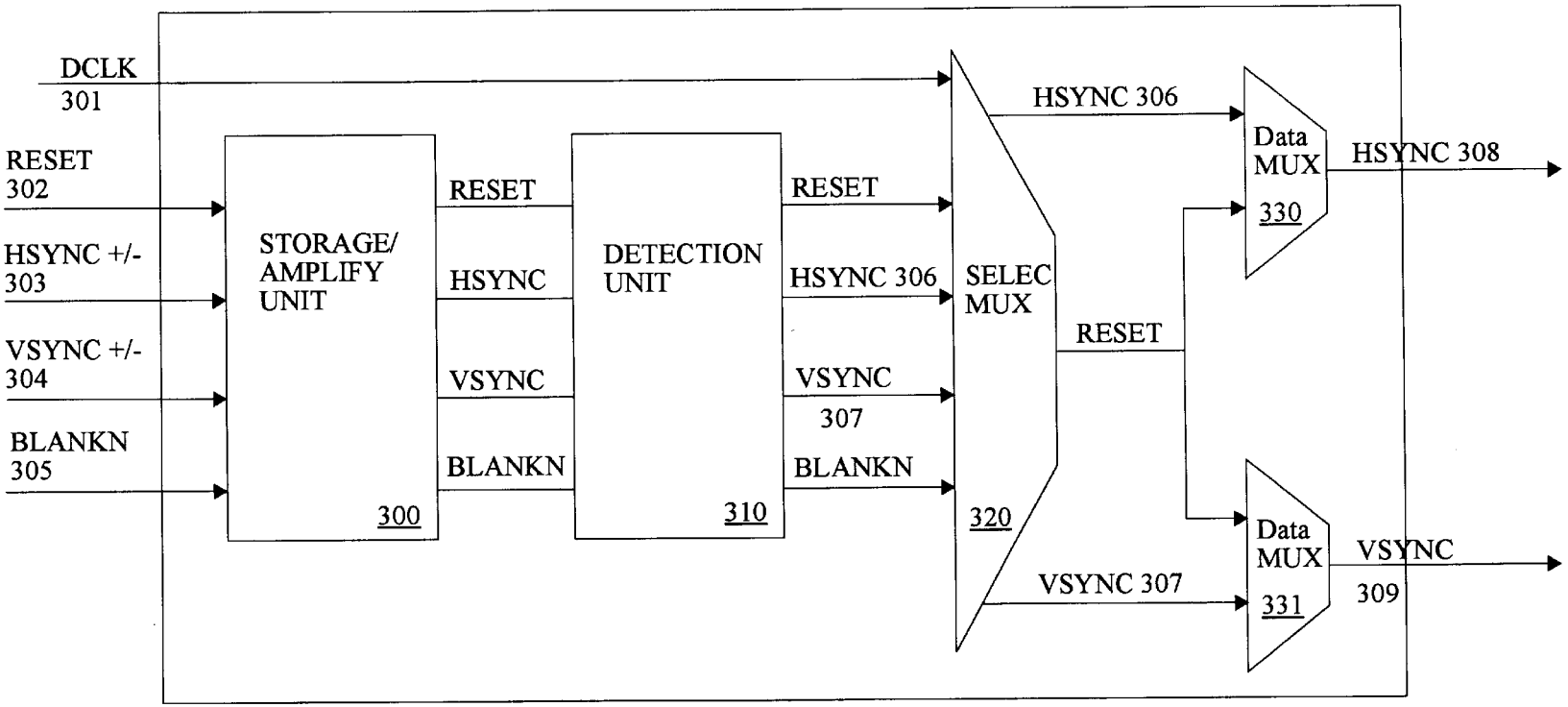
FIG. 3 is a block diagram illustrating an embodiment of the synchronization circuit of the preferred embodiment including a storage unit, a detection unit, and a selection unit.

FIG. 3 illustrates an example of one embodiment of an internal architecture of polarity synchronization unit (UPSC) 200 of the present invention. As shown in FIG. 3, UPSC 200 includes storage unit 300 for storing video signals received in UPSC 200, detection unit 310 coupled to storage unit 300 for ascertaining the polarity of sync signals, signal selection unit 320 coupled to detection unit 310 for selecting and synchronizing sync signals, and a plurality of data muxes 330 and 331 coupled to selection unit 320 for generating synchronized sync signals to VGA 130. VGA 130 generates vertical synchronized and horizontal synchronized signals HSYNC±303 and VSYNC±304, as well as a blankn signal BLANKN 305 which comprises vertical and horizontal blanking signals to UPSC 200. UPSC 200 receives a system reset signal RESET 302 which when asserted refreshes all the video signals received by UPSC 200 from VGA 130. VGA 130 generates source VSYNC±304, HSYNC±303, and BLANKN 305 signals to UPSC 200. CPU 110 generates RESET 302 and a clock (DCLK) 301 signals to UPSC 200 to refresh and time the video signals in UPSC 200 respectively.

Video signals stored in the storage unit 300 include RESET signal 302, input horizontal synchronization signal HSYNC±303, input vertical synchronization signal VSYNC±304, and BLANKN signal 305. It should be noted that HSYNC±303 and VSYNC±304 signals received by UPSC 200 may or may not be of the same polarity depending on the display resolution in display monitor 140.

Detection unit 310 is coupled to storage unit 300 to receive the stored display signals 302–305. Detection unit 310 detects and ascertains polarity of HSYNC±303 and VSYNC±304 signals 304 generated by VGA 130. Detection unit 310 also includes a synchronization logic that synchronizes polarity of HSYNC±303 and VSYNC±304 using predetermined data, specifically status of the BLANKN signal 305, which is stored in detection unit 310. Detection unit 310 is coupled to selection unit 320 via video signal lines 302–307.

Selection unit 320 receives as its inputs signals 302 through 305 and clock signal DCLK 301 which is used to time detection unit 310 and selects synchronized sync signals HSYNC 306 and VSYNC 307 in response to input sync signals HSYNC±303 and VSYNC±304 generated by VGA 130. Selection unit 320 drives selected synchronized sync signals to data selection units 330 and 331 in UPSC 200. Inputs of data selection units 330 and 331 are coupled to selection unit 320 to received synchronized sync signals from selection unit 320 and to drive synchronized sync signals HSYNC 308 and VSYNC 309 to VGA 130.

Figure 4:
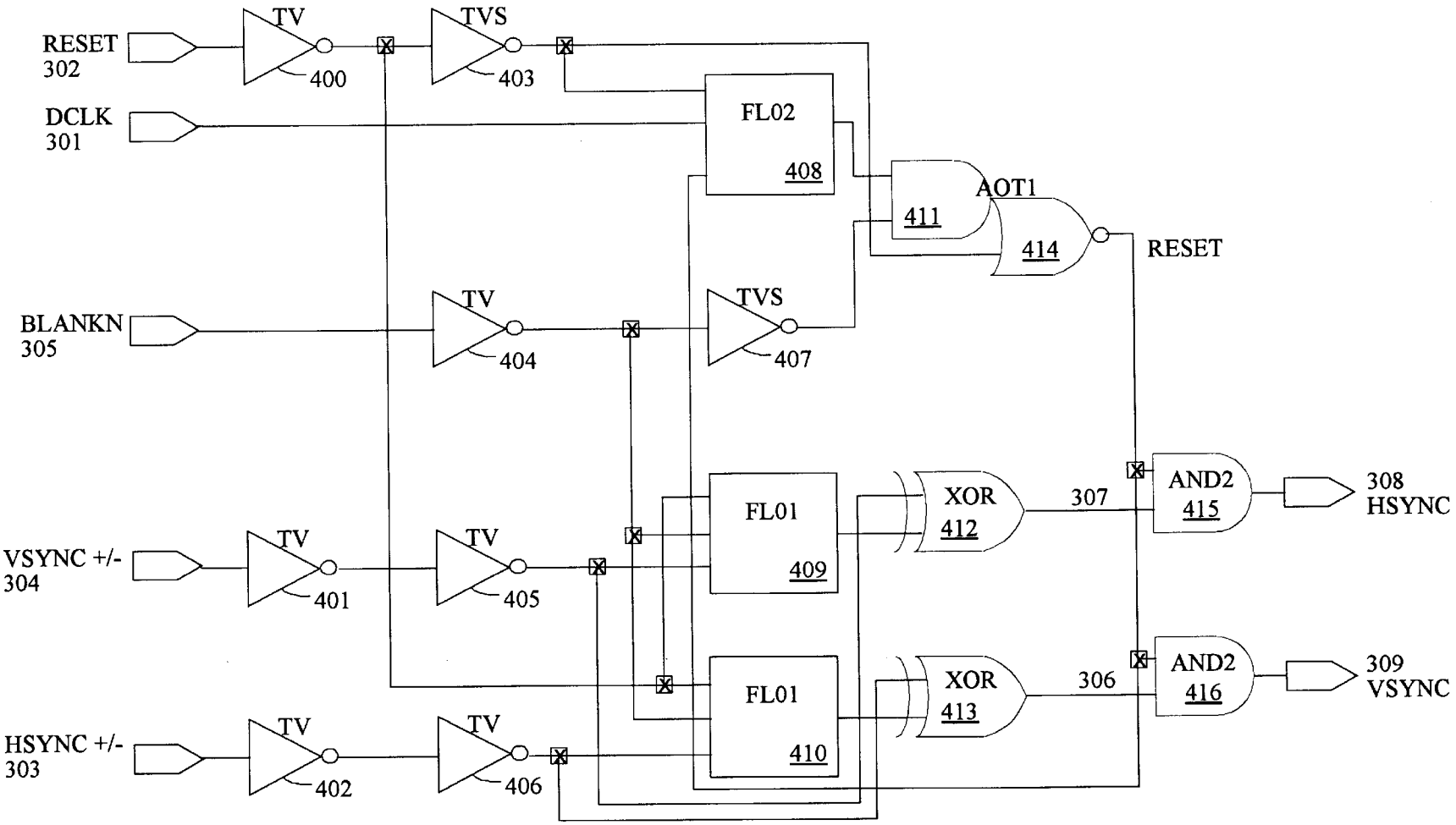
FIG. 4 is a block diagram illustrating the internal circuitry of one embodiment of the synchronization circuit of the preferred embodiment.

FIG. 4 is a simplified block diagram showing internal circuitry of UPSC 200 of the present invention. The circuitry shown in FIG. 4 makes up the functional units illustrated in FIG. 3.

Storage unit 300 comprises a first plurality of inverters 400–402 for storing sync signals 303–304 and hardware reset signal 302 and a second plurality of inverters 403–406 coupled to the first plurality of inverters 400–402 to receive and amplify video signals HSYNC±303 and VSYNC±304, received by video processing card 150. In the present invention, the status of BLANKN signal 305 may be used as a basis to convert the polarity of sync signals HSYNC±303 and VSYNC±304 in detection unit 310. For example, if the vertical blanking signal of BLANKN 305 is deasserted, the polarity of VYSNC± signal 304 may be converted from positive to negative depending on the input polarity of VSYNC±304 when received in detection unit 310.

Detection unit 310 comprises a plurality of flip flops 408–410 which couple to the second plurality of inverters 403–406 in storage unit 300 to receive and ascertain the polarity of sync signals HSYNC±303 and VSYNC±304. Detection unit 310 also includes an inverter 407 for buffering BLANKN signal 305 received by video processing card 150. In one embodiment of the present invention, BLANKN signal 305 may be used to enable the plurality of flip-flops 408–410 in detection unit 310. The polarity of input sync signals HSYNC±303 and VSYNC±304 may also be latched and preserved on the falling edge of BLANKN signal 305 in detection unit 310 prior to passing to input sync signals HSYNC±303 and VSYNC±304 to selection unit 320.

Signal selection unit 320 comprises a plurality of exclusive-OR gates 412 and 413 which are coupled to the detection unit 310 to receive and convert polarity of sync signals received by selection unit 320. Selection unit 320 also includes AND gate 411 which is coupled to detection unit 310 to receive as its inputs video clock (dclk) 301 and BLANKN 305 signals respectively and whose output is coupled to NOR gate 414. NOR gate 414 also receives as its input reset signal 302.

Data muxes 415 and 416 couple to signal selection unit 320 to generate synchronized sync signals to VGA 130. Data mux 415 receives as one of its inputs the synchronized VSYNC signal 308 and as another input hardware reset signal 302, through NOR gate 414. Data mux 415 generates as its output synchronized HSYNC signal 306 once hardware reset signal RESET 302 is deasserted.

Data mux 416 has as one of its inputs HSYNC signal 306 and as the other input hardware reset signal RESET 302. Data mux 416 generates as its output synchronized HSYNC signal 308 which is synchronized to VSYNC signal 309 to VGA 130 when RESET signal 302 is deasserted.

To illustrate how UPSC 200 operates in synchronizing polarity of a pair of sync signals, assume VGA 130 issues signal VYSNC±304 with a positive polarity and signal HSYNC±303 with negative polarity that are received by storage unit 300 in UPSC 200 with reset signal 400 deasserted. VSYNC± signal 304 is stored in the inverter 401 and HSYNC± signal 303 is stored in inverter 402. The RESET signal 302 is stored in the inverter 400.

Inverters 401 and 402 respectively receive and invert sync signals HSYNC±303 and VSYNC±304 received in storage unit 300 and pass the inverted source sync signals HSYNC±303 and VSYNC±304 to a second plurality of inverters (i.e., 405 and 406). Inverters 405 and 406 invert previously inverted source sync signals HSYNC±303 and VSYNC±304 resulting in amplification and reverting of source sync signals 303 and 304 to their original polarity. In addition to amplifying sync signals HSYNC±303 and VSYNC±304, inverter 403 also buffers RESET signal 302 and passes it to flip-flop 408 in detection unit 310 to refresh each sync signal when asserted.

Upon receiving VSYNC± signal 304, flip-flop 409 takes RESET signal 302, BLANKN signal 305, and VSYNC± signal 304 and generates VSYNC± signal 304 to signal selection unit 320. Flip-flop 410 also receives RESET signal 302, BLANKN signal 305, and HSYNC± signal 303 and generates an VSYNC± signal which may be of the same polarity as that received by UPSC 200 to selection unit 320. In one embodiment of the present invention, when source BLANKN signal 305 is asserted on the rising edge of a clock, VYSNC 307 and HYSNC 306 from detection unit 310 shown in FIG. 3, may be delayed thereby causing the polarity of the input sync signals to exclusive-OR 412 and 413 to be inverted respectively.

XOR gate 412 receives as its two inputs the VSYNC signal supplied by flip-flop 409 and buffer 405. The inputs to XOR 412 may have the same polarity depending on whether BLANKN 305 signal is on and the sync polarity of VSYNC±304 signal. Since the two inputs of XOR gate 412 are positive, the output signal generated by XOR gate 412, i.e., VSYNC 307 signal will also be positive.

XOR gate 413 in selection unit 320 receives as its two inputs the HYSNC signal from flip-flop 410 and buffer 406. As with XOR gate 412, the polarity of the inputs to XOR gate 413 may be the same, i.e., negative, and XOR gate 413 generates a positive HSYNC 306 signal to AND gate 416 in selection unit 320.

AND gate 415 in signal selection unit 330 receives as its inputs RESET signal 302 and the positive VSYNC 307 signal from XOR gate 412 and generates a positive VSYNC signal 309 to VGA 130. AND gate 416 similarly receives as its inputs RESET signal 302 and positive HSYNC signal 303 from XOR gate 413 and generates a positive HSYNC signal 308 to VGA 130.

Figure 5:
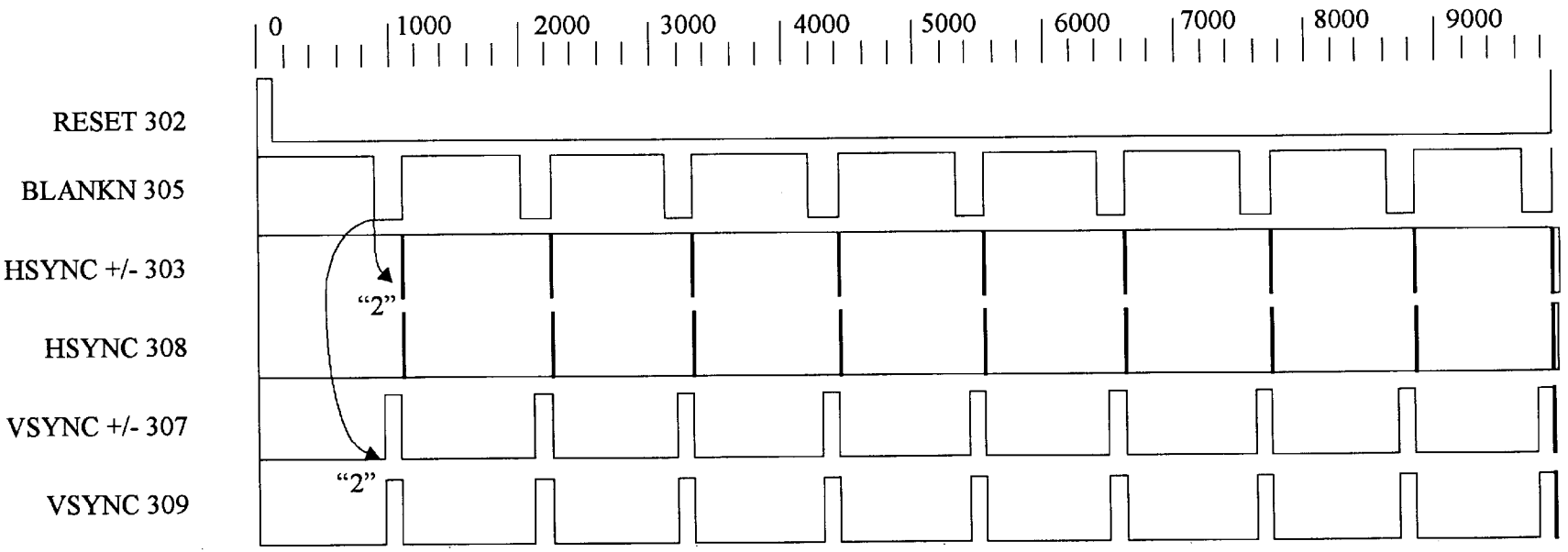
FIG. 5 is an exemplary timing diagram illustrating the synchronization of an input VSYNC signal with a positive polarity and an HSYNC signal with a negative polarity.

FIG. 5 is a timing diagram illustrating synchronization of a positive VSYNC±304 and a negative HSYNC±303 signal by UPSC 200. Referring to FIG. 5, RESET signal 302 is asserted at clock zero to begin synchronization of sync signals.

As illustrated in FIG. 5, when BLANKN signal 305 is asserted (low), the polarity of input HSYNC± signal 303 and input VSYNC± signal 304 are latched until the falling edge of BLANKN signal 305. Polarity of input sync signals HSYNC±303 and VSYNC±304 are synchronized on the rising edge of BLANKN signal 305. Thus, in the example shown in FIG. 5, on the falling edge of BLANKN signal 305, the polarity of HSYNC signal 303 is negative and the polarity of VSYNC± signal 304 is positive. Polarity of the sync signals are latched at "Z" as shown in FIG. 5, and synchronized at the rising edge of BLANKN signal 305 (i.e. both signals 331 and 332 have positive polarity).

Thus, a method and apparatus for automatically synchronizing polarity of vertical and horizontal sync signals in a computer system is described. From the above description, it will be apparent that the invention disclosed herein provides a novel and advantageous method and apparatus for synchronizing polarity of video signals in a computer system. The foregoing discussion discloses and describes exemplary methods and embodiments of the present invention. As will be understood by those familiar with the art, the invention may be embodied in other specific forms without departing from its spirit or essential characteristics, and thus, the described embodiment is not restrictive of the scope of the invention. The following claims are indicative of the scope of the invention. All variations which come within the meaning and range of equivalency of the claims are to be embraced within their scope.

What is claimed is:

1. A circuit for automatically synchronizing the polarity of a synchronization portion of input video signals to create a plurality of output video signals having a predetermined synchronization polarity, said circuit comprising:

storage means receiving the synchronization portion of the input video signals, receiving a synchronization blanking signal, and storing the synchronization portion of the input video signals when the synchronization blanking signal is asserted;

signal detection means coupled to said storing means for automatically detecting and ascertaining polarity of the synchronization portion of the input video signals; and signal selection means coupled to said signal detection means for selecting and decoding polarity of the synchronization portion of the input video signals, said signal selection means converting and synchronizing the polarity of the synchronization portion of the input video signals and generating a plurality of output video signals with the predetermined synchronized polarity when the synchronization blanking signal is de-asserted, wherein said storage means further comprises an amplification means for amplifying the synchronization portion of the input video signals when received in said storing means.

2. The circuit of claim 1, wherein the input video signals includes at least a clock signal, the clock signal coupled to said selection means for timing said detection means and for selecting output video signals responsive to the input video signals.

3. The circuit of claim 2, wherein the synchronization of the input video signals includes a vertical synchronization signal and a horizontal synchronization signal.

4. The circuit of claim 3, wherein said detection means includes an amplification means for amplifying a first signal of the synchronization portion of the input video signals.

5. The circuit of claim 4, wherein said selection means includes a means for storing predefined data to synchronize polarity of output video signals.

6. A video signal processor for automatically detecting and selectively converting polarity of a synchronization portion of input video signals depending upon the display resolution of a display unit, said processor comprising:

a buffer unit receiving a synchronization portion of input video signals and a synchronization blanking signal and storing the synchronization portion of the input video signals when the synchronization blanking signal is asserted;

signal detection unit coupled to said buffer unit to receive and automatically determine polarity of the synchronization portions of the input video signals; and selection unit coupled to said detection unit for decoding and converting the polarity of the synchronization portion of input video signals to generate a plurality of output signals with a synchronized polarity when the synchronization blanking signal is deasserted.

7. The processor of claim 6, wherein synchronization portion of the input video signals include a horizontal synchronization signal and a vertical synchronization signal.

8. The processor of claim 7, wherein said buffer unit includes a plurality of amplification circuits for amplifying the input video signals.

9. The processor of claim 8, wherein said selection unit includes a synchronization circuit to synchronize the polarity of output video signals responsive to the synchronization portion of the input video signals.

10. In a computer system having a video circuit card for processing video signals, said video circuit card including a video circuit decoder for automatically synchronizing the polarity of a plurality of output video signals corresponding to a plurality of input video signals received in said computer system, said video circuit decoder comprising:

a storage unit for temporarily storing a synchronization portion of the input video signals in response to an asserted synchronization blanking signal;

a selection unit, coupled to said storage unit, for determining polarity of the synchronization portion of the input video signals; and a synchronization unit for decoding and synchronizing polarity of the synchronization portion of the video signals, said synchronization unit generating a plurality of synchronized polarity output video signals when the synchronization blanking signal is deasserted.

11. The circuit decoder of claim 10, wherein the synchronization portion of the input video signals includes a vertical synchronization signal and a horizontal synchronization signal.

12. The circuit decoder of claim 11, wherein said storage unit includes a plurality of amplification circuits for amplifying the synchronization portion of the input video signals.

* * * * *